United States Patent [19]

Haas

[11] Patent Number: 4,788,804

[45] Date of Patent: Dec. 6, 1988

[54] SKYLIGHT

[75] Inventor: Fred Haas, Unionville, Canada

[73] Assignee: Viceroy Homes Limited, Scarborough, Canada

[21] Appl. No.: 47,322

[22] Filed: May 8, 1987

[30] Foreign Application Priority Data

Aug. 28, 1986 [CA] Canada ..... 517040

[51] Int. Cl.[4] ..... E04B 7/18

[52] U.S. Cl. ..... 52/200; 52/397; 52/475; 49/DIG. 1

[58] Field of Search ..... 52/200, 309.1, 475, 52/397; 49/DIG. 1, DIG. 2

[56] References Cited

U.S. PATENT DOCUMENTS

| | | | |
|---|---|---|---|
| 2,067,118 | 1/1937 | Case | 49/406 |
| 2,847,726 | 8/1958 | Frick | 52/207 |
| 3,383,801 | 5/1968 | Pallaire | 49/458 |
| 3,859,754 | 1/1975 | Budich et al. | 49/504 X |
| 4,040,219 | 8/1977 | Budich | 52/775 |
| 4,073,097 | 2/1978 | Jentoft et al. | 52/200 X |
| 4,123,883 | 11/1978 | Barber, Jr. et al. | 52/200 |
| 4,319,430 | 3/1982 | Menard | 52/207 |
| 4,388,784 | 6/1983 | Jentoft et al. | 52/900 |
| 4,398,373 | 8/1983 | Mancuso | 49/425 |
| 4,409,767 | 10/1983 | Jentoft et al. | 52/200 |
| 4,420,907 | 12/1983 | Swan | 49/404 X |
| 4,449,340 | 5/1984 | Jentoft et al. | 52/200 |
| 4,473,929 | 10/1984 | Bruhm | 52/200 |
| 4,524,112 | 6/1985 | Willert | 49/504 |
| 4,554,770 | 11/1985 | Anders | 52/207 |
| 4,580,366 | 4/1986 | Hardy | 49/406 |
| 4,640,061 | 2/1987 | Trumley | 52/71 |
| 4,674,246 | 6/1987 | Giguere | 52/207 |

FOREIGN PATENT DOCUMENTS

| | | | |
|---|---|---|---|
| 2029972 | 12/1971 | Fed. Rep. of Germany | 49/404 |
| 2729287 | 1/1979 | Fed. Rep. of Germany | 49/504 |
| 2800881 | 7/1979 | Fed. Rep. of Germany | 49/504 |
| 3009324 | 9/1981 | Fed. Rep. of Germany | 52/200 |
| 2036158 | 12/1970 | France | 52/200 |
| 2393126 | 2/1979 | France | 52/200 |
| 355927 | 9/1961 | Switzerland | 49/401 |
| 1210410 | 10/1970 | United Kingdom | 49/504 |
| 2116617 | 9/1983 | United Kingdom | 49/408 |
| 2179693 | 3/1987 | United Kingdom | 49/504 |

*Primary Examiner*—David A. Scherbel
*Assistant Examiner*—Richard E. Chilcot, Jr.
*Attorney, Agent, or Firm*—George A. Rolston

[57] ABSTRACT

A skylight window having a window base frame to be received in a window opening, a window housing to receive glazing, and, a glazing frame to be attached to the housing for retaining the glazing, the base, housing and frame all being formed of extruded thermoplastic.

4 Claims, 2 Drawing Sheets

SKYLIGHT

The invention relates to thermoplastic windows, and in particular to skylights of the type which may be installed in a roof.

BACKGROUND OF THE INVENTION

Skylight type windows such as are installed in a roof, present a combination of problems, including aesthetic appeal, ease of installation, economy in manufacture, thermal insulation, and weatherproofing.

By far the most important factor however is the provision of a complete weather seal, preventing entry of moisture as a result of rain, snow, ice and the like.

Windows are available which satisfy one or some of these requirements, but generally speaking it has not been possible to achieve a satisfactory solution to all of these requirements in any one window.

Various different materials have been used in the past for such windows, with mixed results. Extrusion of a window frame in plastics material typically vinyl plastics material offers numerous advantages from the viewpoint of economy, and weather resistance. However, in the past vinyl extruded windows of this type have generally speaking been either excessively complex in design or else have provided an inadequate seal either between the roof and the window frame, or between the frame and the glazing.

Preferably the window frame consists of an essentially one-piece integral design, but it may be difficult to manufacture. In this case it may be advantageous if the window frame is a two-part design, consisting of a window base and flashing, and a window housing attached to the window base.

BRIEF SUMMARY OF THE INVENTION

With a view to overcoming the various disadvantages noted above, the invention provides a window comprising a generally rectangular four-sided window base, adapted to be received in a window opening in a building structure, a generally four-sided rectangular window housing adapted to receive glazing therein, and a glazing frame securing the glazing to the housing.

More particularly, it is an objective of the invention to provide a window having the foregoing advantages including roof flashing means formed on said base, extending outwardly therefrom around all four sides thereof.

More particularly, the invention provides a window having the foregoing advantages including flange means formed on said window housing, shoulder means formed adjacent said flange means, said shoulder means and said flange means extending continuously around all four sides thereof, said flange means being adapted to receive glazing thereon, and said glazing frame being adapted to be received on said shoulder means for locking said glazing on said flange means.

More particularly, the invention comprises a window having the foregoing advantages wherein said window base is formed with upstanding continuous tongues, and abutment means formed on said tongues, and wherein said window housing is formed with a continuous channel, adapted to receive said tongues, and trap said abutment means therein.

The various features of novelty which characterize the invention are pointed out with particularity in the claims annexed to and forming a part of this disclosure.

For a better understanding of the invention, its operating advantages and specific objects attained by its use, reference should be had to the accompanying drawings and descriptive matter in which there are illustrated and described preferred embodiments of the invention.

IN THE DRAWINGS

FIG. 1 is a general perspective illustration of a window according to the invention, with a portion of a building structure shown for the sake of clarity, and, FIG. 2 is a section along the line 2—2 of FIG. 1.

DESCRIPTION OF A SPECIFIC EMBODIMENT

Figure 1:
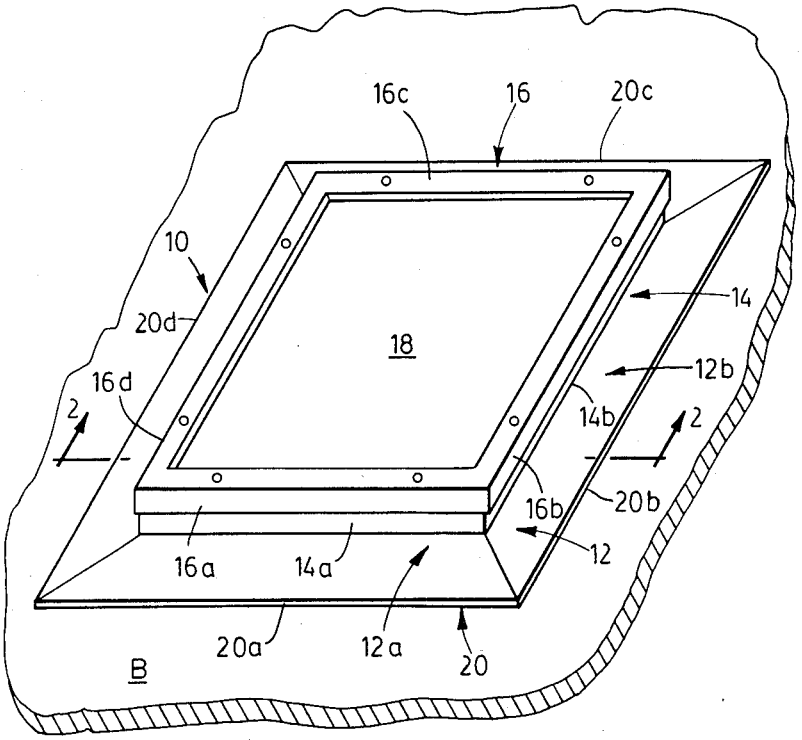

Referring first of all to FIG. 1, it will be seen that the invention is illustrated in the form of a skylight type window indicated generally as 10, shown mounted in position in a building structure shown schematically as B. The structure B in the typical case will be part of a roof. It will of course be appreciated however that this is by no means the only location in which such a window may find application. While the wiindow is described for the purposes of this illustration as a skylight type window, it is not to be regarded as limited or in any way restricted to a window only when used as a skylight, but relates in general to a window having the characteristics described.

Figure 2:
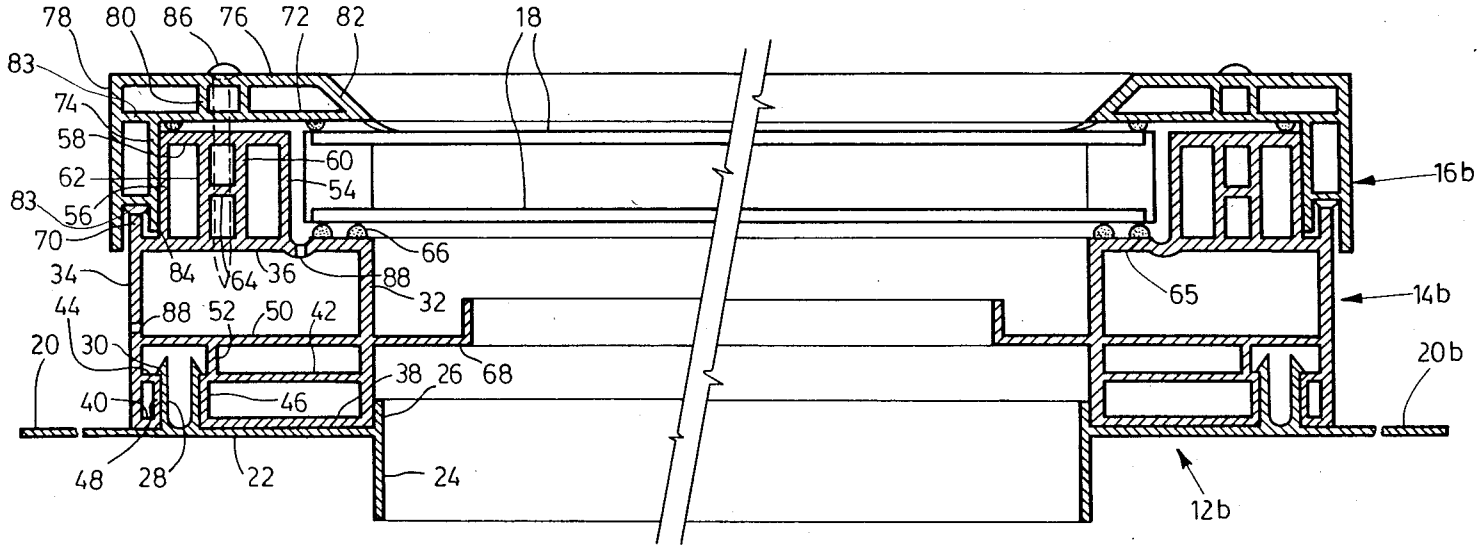

Referring now to FIG. 2, the window 10 will be seen to comprise three basic components namely the base support generally indicated at 12, the window housing generally indicated at 14, and the glazing frame generally indicated at 16. Each of these basic components is assembled from linear members identified by the same legends with the suffices a, b, c and d.

Glazing, indicated generally as 18, is supported in the housing 14, and is retained therein by the frame 16.

Such glazing 18 may take various forms. It may be a single panel of glass, or multiple panels of glass to provide improved thermal insulation. Alternatively, it may be a single panel of plastic, or multiple panels of plastic such as "Plexiglass" (trade mark), and such plastic panels may be shaped or moulded or formed into a variety of different shapes all as is well known in the art.

Also shown in FIG. 1 is the flashing strip generally indicated at 20, comprising individual members 20*a*, 20*b*, 20*c* and 20*d*, extending all around the base 12 and formed integrally with it. The flashing is intended to extend over a marginal area of the structure B around the window opening. Some exterior coverings (not shown) which in the case of a roof may be for example tiles, asphalt or the like, will overlap the flashing strip 20. Various different arrangements for overlapping and interleaving are well known in the art, and appropriate sealing or grout materials will also be used, in accordance with well known practice. Such covering materials, seals and the like are omitted for the sake of clarity.

As best shown in FIG. 2, the base 12, housing 14, and frame 16 are all formed of continuous extrusions, which are designed to interfit with one another in a manner described below.

Thus the base 12 comprises the four portions 12*a-b-c-d*, cut from an identical extrusion. The extrusion comprises a planar web 22, formed integrally with the flashing strip 20, which consists in this embodiment merely of an outward extension of the web 22. A generally right angled inward flange 24 is formed on the inner edge of web 22, and a generally outward flange 26 is formed on the same edge of web 22.

Suitable openings (not shown) may be formed in the web 22 at intervals for fastening to the structure B.

Engagement means in the form of a pair of outwardly upstanding tongues 28 are formed along the outward surface of web 22. The tongues 28 are formed in spaced-apart parallel location, and are designed to permit a limited degree of flexing towards one another. At their outward ends, they are provided with retaining formations comprising hooks 30, the purpose of which will be readily apparent from the illustrations, and which is in any event described below.

The housing 14 comprises a generally rectangular box-like section defined by inner wall 32, outer wall 34, and top wall portion 36. A lower wall 38 extends from inner wall 32, normal thereto and parallel to top wall 36. A further lower wall portion 40 extends from outer wall 34, coplanar with lower wall 38.

The two lower wall portions 38 and 40 are in turn supported internally by support walls 42 and 44 extending parallel thereto from inner and outer walls 32 and 34 respectively. A channel is defined by spaced apart channel side walls 46 and 48, extending between lower walls 38 and 40, and between support walls 42 and 44. The channel walls are spaced apart a predetermined distance so as to fit closely around the tongues 28, and the channel side walls 46 and 48 have a predetermined length equal to the spacing between the hooks 30 and the web 22 of the base support.

A bracing wall 50 extends between inner and outer walls 32 and 34, and a further connector wall 52 extends between bracing wall 50 and support wall 42.

On the outwardly directed surface of top wall 36, a further rectangular structure is integrally formed comprising channel walls 54 and 56, and top web 58, the channel walls 54 and 56 being rooted integrally on top wall 36.

Between the two channel walls a pair of bracing walls 60 and 62, and a transverse web 64 reinforce the interior of the structure, and connect top web 58 with top wall 36.

It will be noted that channel wall 54 is spaced away from the plane of inner wall 32, thereby defining a generally right-angular ledge or notch 65, against which the glazing may be received.

Suitable sealing strips 66 are formed on the upper surface of top wall 36 adjacent channel wall 54 for receiving the edge of the glazing.

A trim flange 68, of generally L-shaped design is formed integrally on the inner surface of inner wall 32 coplanar with bracing wall 50.

An outer locating flange 70 is formed at the junction between outer wall 34 and top wall 36, extending coplanar with wall 34.

In order to retain the glazing 18 on the ledge 65, the glazing frame 16 is provided, which comprises in section an inward clamping wall 72, and an inner locating wall 74, normal to one another, which are adapted to fit around walls 56 and 58, and extend over the edge of the glazing 18.

Facing walls 76 and 78 are connected to walls 72 and 74 by junction walls 80 registering with bracing walls 60 and 62, and an angled bevel wall 82 and walls 83.

Walls 74 and 78 define a downwardly directed channel 84 designed to receive the outer locating flange 70.

Any suitable fastening means such as screws 86 can be passed through the glazing frame 16 and into the space between junction walls 80 and bracing walls 60 and 62.

Suitable seals are provided on the interior of the facing wall 72 to engage the glass.

Typically, drain openings indicated as 88 will be drilled in the lowermost portion of the walls 34 and 36 to permit drainage of any moisture which may collect.

In operation, the base support 12 is welded at all four corners.

The window housing 14 is welded at its corners and is fastened on the base web simply by placing the housing channel defined by the channel side walls 46 and 48 over the tongues 28, and pressing downwardly until the hooks 30 snap into position.

The glazing 18 is then placed in the housing and the frame 16 is fastened, by screws.

The window may then be secured in position on the building.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A skylight window comprising:

a four-sided window base frame formed of extruded thermoplastic adapted to be received in a window opening in a building structure;

roof flashing means formed on said base frame, extending outwardly therefrom around all sides thereof;

a window housing connected to said base frame and adapted to receive glazing therein;

said window housing comprising in section a first rectangular four-sided structure formed of extruded thermoplastic and having inner and outer walls and upper and lower walls, and interior supporting walls formed therein along its length, a second rectangular tubular structure formed on said upper wall of said first rectangular tubular structure, said second rectangular structure defining inner and outer walls and a top wall, said inner wall being located in a plane offset outwardly with respect to said inner wall of said first structure, whereby to define a flange means to receive glazing thereon, parallel spaced apart bracing walls located on the interior of said second tubular structure, said bracing walls being spaced apart a distance appropriate to receive fastening means therebetween;

a glazing frame adapted to be attached to said housing for retaining glazing therein; and, said glazing frame comprising a generally L-shaped tubular structure in section, defining inner and outer walls adapted to overlie said top wall of said second tubular structure of said window housing, and adapted to overlie said glazing on said flange means, whereby to engage said glazing on said flange means and clamp the same in position, and junction walls extending between said inner and outer walls and registering with said bracing walls in said housing, to receive fastenings therein.

2. A skylight window as claimed in claim 1 including first engagement means on said base frame in the form of upstanding continuous tongues, and abutment means formed on said tongues, and second engagement means on said window housing in the form of a continuous channel, adapted to receive said tongues, and trap said abutment means therein.

3. A skylight window as claimed in claim 1 including an interior trim flange formed on said inner wall of said first tubular portion of said window housing, extending inwardly therefrom.

4. A skylight window as claimed in claim 1 including drain holes in top wall and said outer wall of said second tubular structure of said window housing.

* * * * *